US007434772B1

(12) United States Patent
Jou

(10) Patent No.: US 7,434,772 B1
(45) Date of Patent: Oct. 14, 2008

(54) RACK FOR DRIERS

(76) Inventor: Wuu-Cheau Jou, No. 497-6, Caohu Rd., Dali City, Taichung County 412 (TW)

( * ) Notice: Subject to any disclaimer, the term of this patent is extended or adjusted under 35 U.S.C. 154(b) by 0 days.

(21) Appl. No.: 11/746,713

(22) Filed: May 10, 2007

(51) Int. Cl.
*A47F 5/00* (2006.01)

(52) U.S. Cl. ..... 248/124.2; 248/125.7; 248/176.3

(58) Field of Classification Search ..... 248/676, 248/122.1, 124.1, 124.2, 125.1, 125.3, 125.7, 248/158, 159, 165, 176.1, 176.3; 34/96, 34/97; 416/244 R, 246, 120; 211/13.1, 26, 211/195, 196, 175, 182, 205, 207; 219/222; 403/400, 53
See application file for complete search history.

(56) References Cited

U.S. PATENT DOCUMENTS 1,777,185 A * 9/1930 Thompson ..... 248/124.2
1,952,945 A * 3/1934 Sawada ..... 359/723
2,124,006 A * 7/1938 Parker ..... 248/124.2
2,418,067 A * 3/1947 Carpenter, Sr. ..... 206/578
2,479,720 A * 8/1949 Brandt ..... 248/123.2
2,598,529 A * 5/1952 Fritz ..... 248/457
2,599,269 A * 6/1952 Markle ..... 396/5
3,031,215 A * 4/1962 Vance ..... 403/59
3,223,826 A * 12/1965 Macaluso, Jr. ..... 392/413
4,523,256 A * 6/1985 Small ..... 362/11
4,671,478 A * 6/1987 Schoenig et al. ..... 248/124.1
5,403,162 A * 4/1995 Chen ..... 416/246
5,485,993 A * 1/1996 Lipsett ..... 473/448

* cited by examiner

*Primary Examiner*—Korie H. Chan
(74) *Attorney, Agent, or Firm*—Alan Kamrath; Kamrath & Associates PA

(57) ABSTRACT

A rack for driers includes a support with a post assembly connected thereto. An inlet unit is connected to the post assembly. A rotatable unit is connected to the post assembly and includes a horizontal sleeve through which a horizontal tube extends. Two drier bases are pivotably connected to the horizontal tube so as to be connected with two driers. Two spiral hoses are connected between the driers and the inlet unit. The horizontal tube and the two driers are able to rotate about an X-axis, a Y-axis and a Z-axis.

8 Claims, 14 Drawing Sheets

RACK FOR DRIERS

FIELD OF THE INVENTION

The present invention relates to a rack having multiple sleeve units so as to allow driers to be rotated in different directions to meet a variety of requirements when drying objects.

BACKGROUND OF THE INVENTION

A conventional rack 1 for driers is shown in FIGS. 10 to 14 and generally includes a support 10, a Y-axis tube 11 and an X-axis tube 31. An outer tube 12 is movably mounted to the Y-axis tube 11 and can be positioned by a screw 121. An inlet unit 20 and a movable member 30 are respectively connected to the outer tube 12. The inlet unit 20 is connected with an inlet pipe 21 connected with a compressor (not shown). Two hoses 22 are respectively connected to the inlet unit 20 so as to provide communication to two driers 40. The X-axis tube 31 is movably connected to the movable member 30, and two drier bases 32 are movably connected to the X-axis tube 31 so that the two driers 40 are connected to the two drier bases 32. It is noted that the two driers 40 can only be moved along the X-axis tube 31 to adjust the working areas 400 to be pivoted about the X-axis tube 31. The two driers 40 are always located on the same horizontal positions, and the X-axis tube 31 cannot be rotated above a Z-axis 301. Besides, the inlet unit 20 is located on the outer tube 12 so that the inlet unit 20 moves with the outer tube 12. When moving the outer tube 12, the inlet pipe 21 is pulled and might drag down the rack 1.

The present invention provides a rack for driers which are able to be moved up and down along a Z-axis direction and rotated about X and Y directions. The inlet unit is located at a low position on the post in the Y-axis direction and does not move with the driers when adjusting the positions of the driers.

SUMMARY OF THE INVENTION

The present invention relates to a rack for driers, and the rack comprises a support having a top hole with which a post assembly is inserted. The post assembly includes a first tube. An inlet unit includes an upright sleeve which is mounted to the first tube, and two threaded holes are defined in two ends of the inlet unit so that two seal nuts are connected with the threaded holes. A threaded hole is defined in a front end of the inlet unit so as to be connected with a connection member to which an inlet hose is connected. Two threaded holes are defined in a top of the inlet unit, and two connection members are connected with the threaded holes. A rotatable unit has a vertical sleeve in a Y-axis direction so as to be mounted to the post assembly, and a threaded hole is defined through the vertical sleeve so that a screw threadedly extends through the threaded hole and contacts against the post assembly. A drier base includes a horizontal sleeve which is mounted to a horizontal tube connected to the post assembly, and a vertical sleeve is connected to the horizontal sleeve. A threaded hole is defined in a top of the vertical sleeve, and a connection member is threadedly connected to the threaded hole. A drier is connected with the connection member. The horizontal sleeve includes a threaded hole in the Y-axis direction, and a screw threadedly extends through the threaded hole so as to fix the drier base to the horizontal tube. A connection portion extends radially from the vertical sleeve, and a threaded hole is defined in a distal end of the connection portion. A connection member is threadedly connected with the threaded hole.

The threaded hole in the distal end of the connection portion communicates with the threaded hole in the top of the vertical sleeve. A spiral hose has one end connected with the connection member on the inlet unit, and the other end of the spiral hose is connected with the connection member on the vertical sleeve of the drier base.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
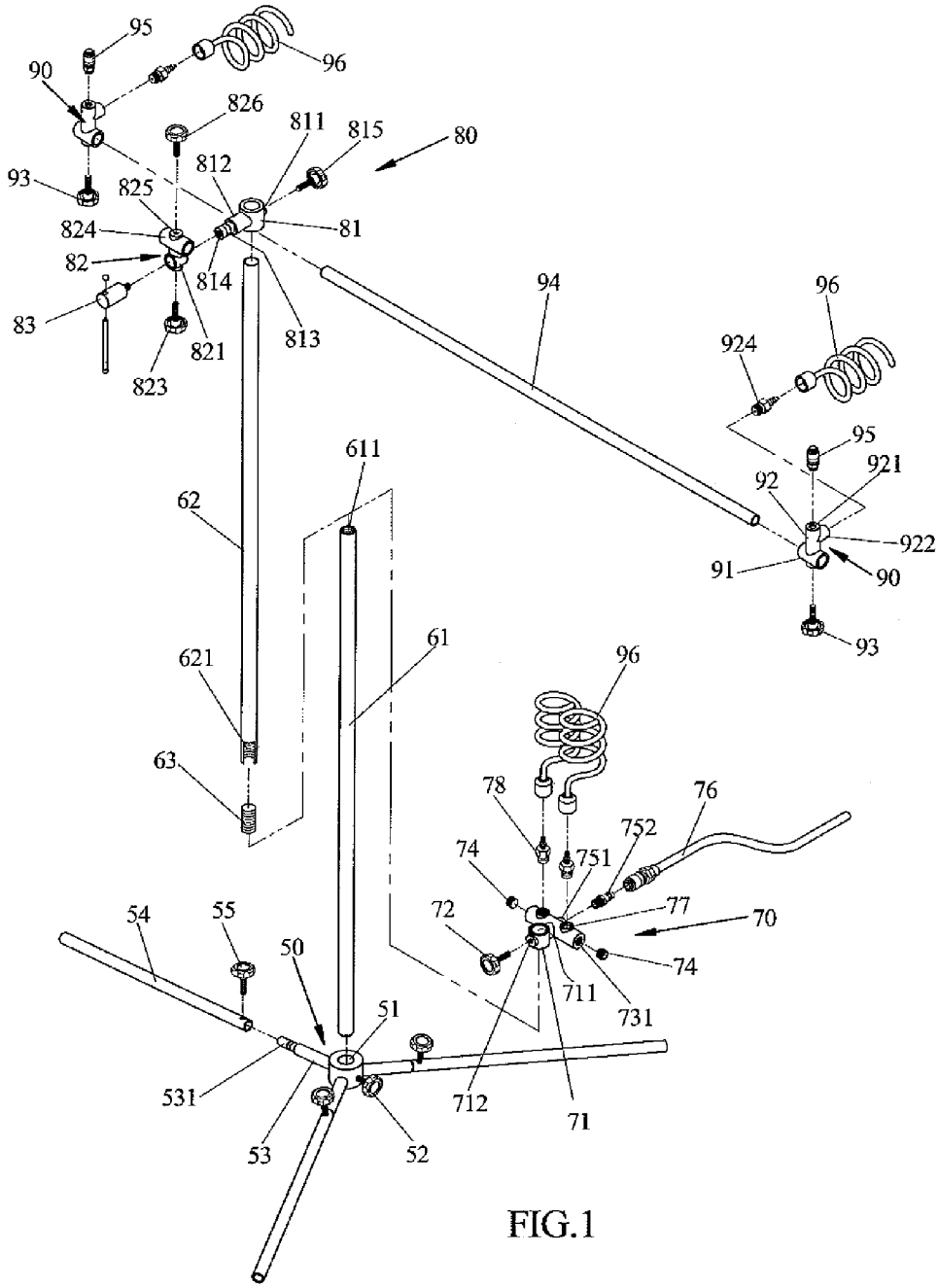
FIG. 1 is an exploded view to show the rack for driers of the present invention.
Figure 2:
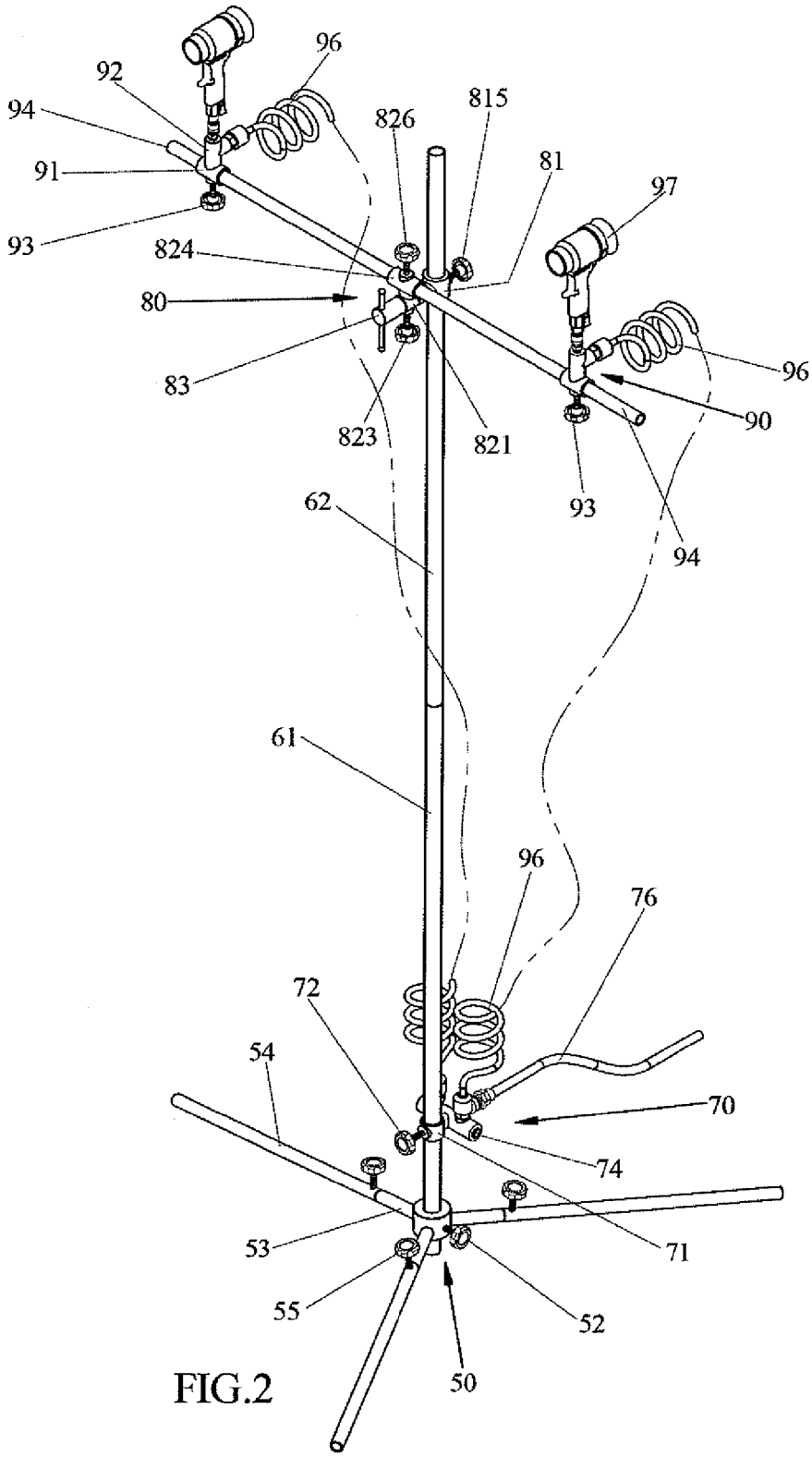
FIG. 2 is a perspective view to show the rack for driers of the present invention.

Referring to FIGS. 1 and 2, the rack for driers of the present invention comprises a support 50 which includes a tubular member with a top hole 51. Three legs 53 extend from the tubular member, and each leg 53 has a neck so as to be connected with an extension tube 54 by a screw 55.

A post assembly in a Y-axis direction is connected with the top hole 51 and includes a first tube 61 and a second tube 62. A threaded hole 621 of the second tube 62 is connected to a threaded hole 611 of the first tube 61 by a connection member 63. The first tube 61 is inserted into the top hole 51 and is fixed by extending a screw 52 through the tubular member. An inlet unit 70 includes an upright sleeve 71 which includes a passage 711 so as to be mounted to the first tube 61 or the second tube 62. A screw 72 threadedly extends through a threaded hole 712 in the upright sleeve 71 to position the inlet unit 70 on the post assembly. Two connection members 78 are respectively connected to two respective threaded holes 77 on a top of the inlet unit 70 so as to be connected with two spiral hoses 96. Another connection member 752 is connected to a threaded hole 751 in a front end of the inlet unit 70 so as to be connected with an inlet hose 76 which is connected to a compressor (not shown). Two end nuts 74 seal two threaded holes 731 defined in two ends of the inlet unit 70.

A rotatable unit 80 has a vertical sleeve 81 in the Y-axis direction so as to be mounted to the post assembly. A threaded hole 811 is defined through the vertical sleeve 81 such that a screw 815 threadedly extends through the threaded hole 811 and contacts against the post assembly. The vertical sleeve 81 of the rotatable unit 80 includes an extension tube 812 extending radially therefrom and which has an insertion section 813. A threaded hole 814 is defined in a distal end of the extension tube 812, and an adjusting member 83 is threadedly connected with the threaded hole 814. The rotatable unit 80 includes a horizontal sleeve 82 which has a connection sleeve 821 mounted to the insertion section 813. A horizontal sleeve 824 is connected to the connection sleeve 821 and through which a horizontal tube 94 extends. The horizontal sleeve 824 includes a threaded hole 825, and a screw 826 is threadably connected to the threaded hole 825 to fix the horizontal tube 94. A threaded hole 822 is defined in an underside of the connection sleeve 821, and a screw 823 is threadably connected to the threaded hole 822 to contact against the insertion section 813.

Figure 5:
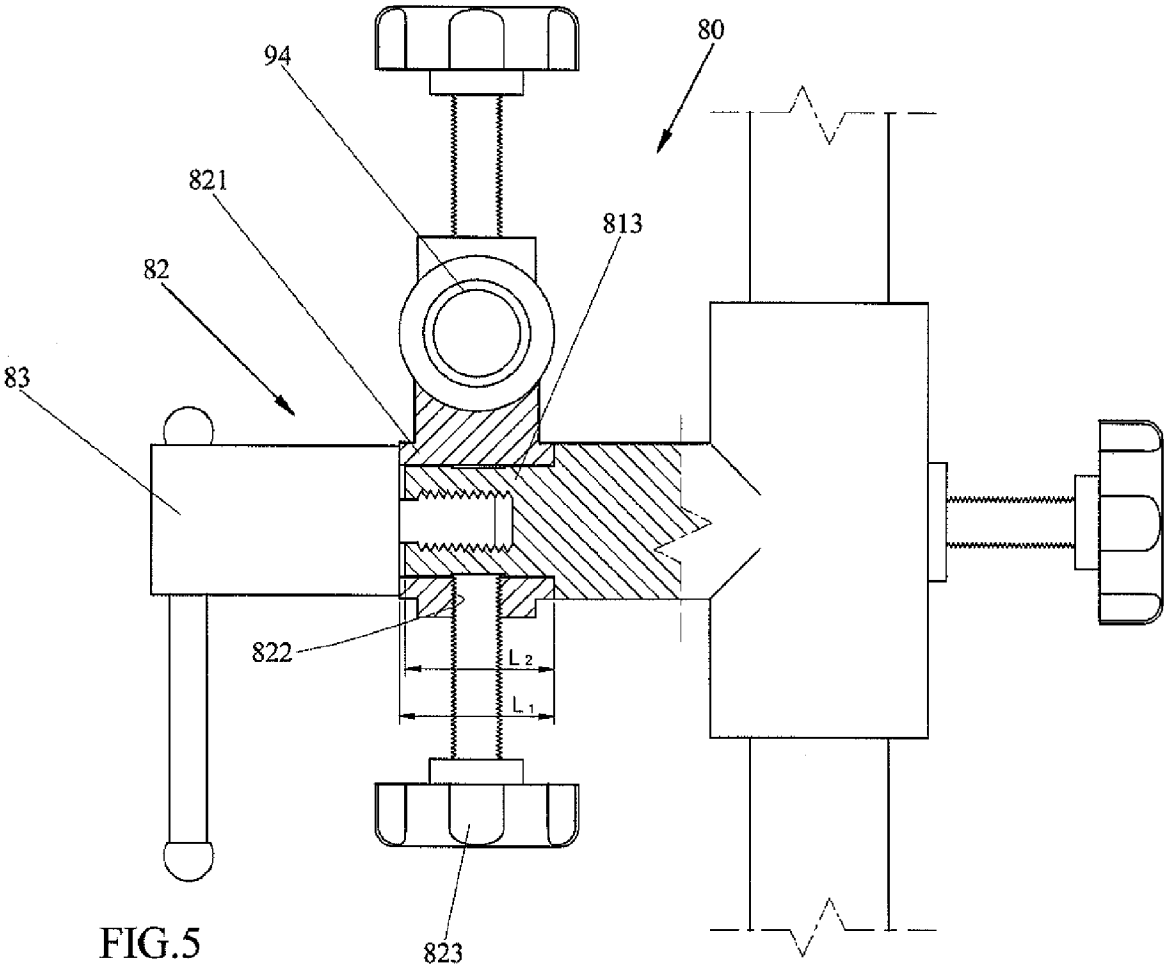
FIG. 5 is a cross sectional view to show the rotatable unit and the adjusting member.

As shown in FIG. 5, a length "L1" of the connection sleeve 821 is longer than a length "L2" of the insertion section 813. Thus, the adjusting member 83 contacts against an end surface of the connection sleeve 821 such that the horizontal sleeve 82 can be positioned after the horizontal tube 94 is pivoted to any position.

Two drier bases 90 each include a horizontal sleeve 91 which is mounted to the horizontal tube 94 connected to the post assembly. A vertical sleeve 92 is connected to the horizontal sleeve 91. A threaded hole 921 is defined in a top of the vertical sleeve 92, and a connection member 95 is threadedly connected to the threaded hole 921. A drier 97 is connected with the connection member 95 corresponding thereto. The horizontal sleeve 91 includes a threaded hole in the Y-axis direction. A screw 93 threadably extends through the threaded hole in the horizontal sleeve 91 so as to fix the drier base 90 to the horizontal tube 94. A connection portion 922 extends radially from the vertical sleeve 92, and a threaded hole is defined in a distal end of the connection portion 922. A connection member 924 is threadably connected with the threaded hole of the connection portion 922. The threaded hole in the distal end of the connection portion 922 communicates with the threaded hole 921 in the top of the vertical sleeve 92. The spiral hose 96 has one end connected with the connection member 78 on the inlet unit 70, and the other end of the spiral hose 96 is connected with the connection member 924 on the vertical sleeve 92 of the drier base 90.

Figure 3:
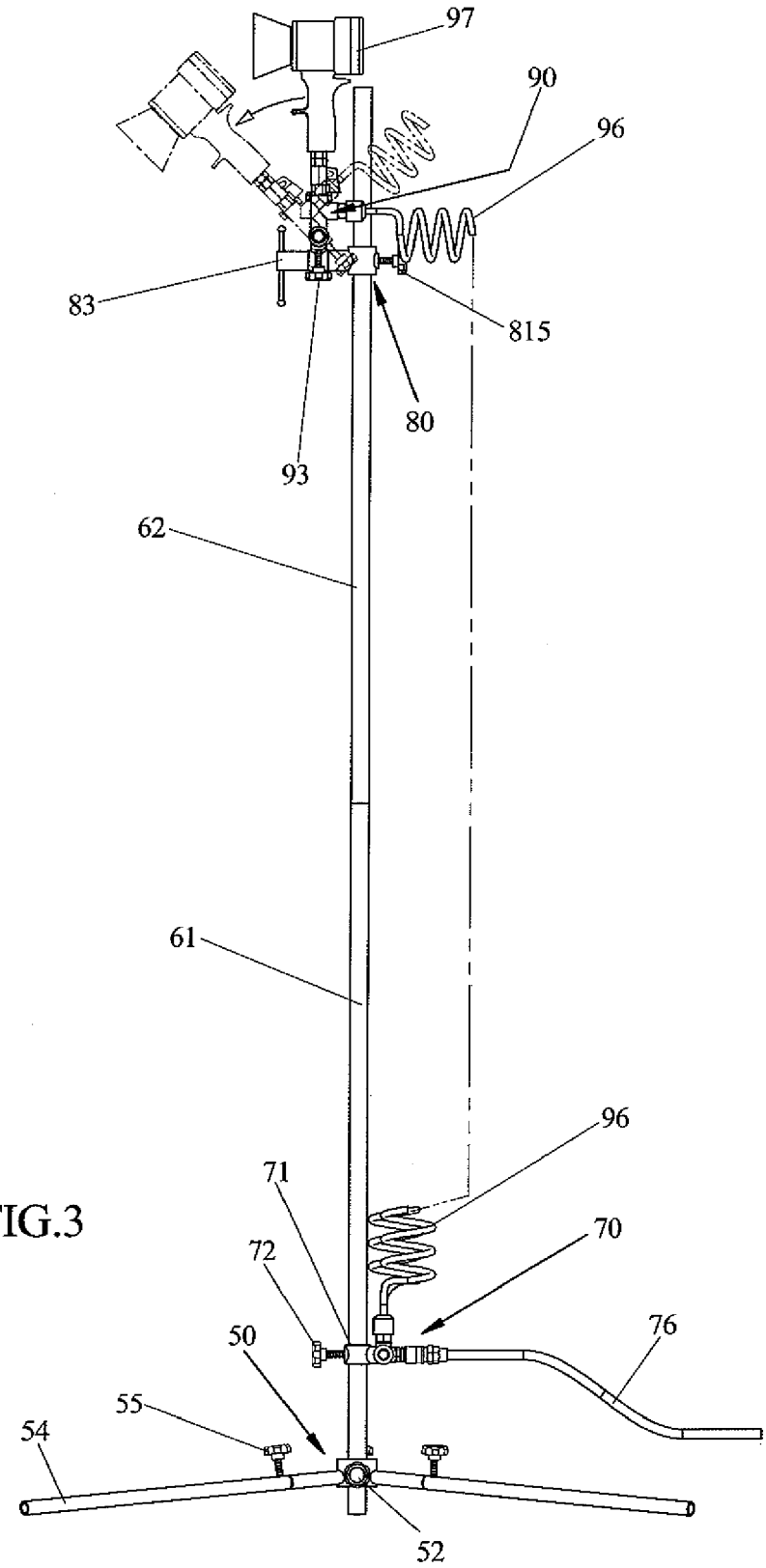
FIG. 3 is a plane view to show that the drier is rotatable relative to the horizontal tube of the rack for driers of the present invention.
Figure 4:
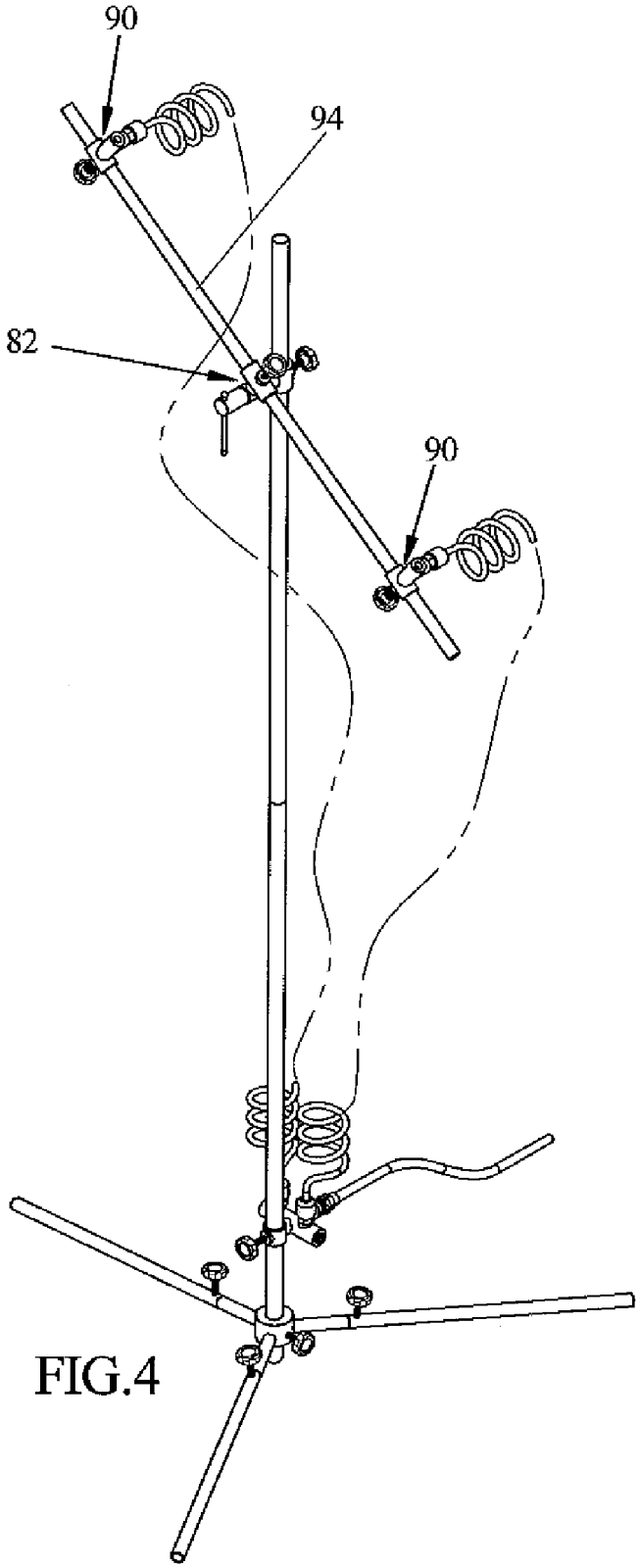
FIG. 4 shows that the horizontal tube is rotatable about the Z-axis direction.

As shown in FIG. 3, the drier base 90 can be rotated about the horizontal tube 94 to change the angular position relative to the object (not shown) in front of the driers 97. FIG. 4 shows that the horizontal tube 94 is rotated about the Z-axis direction to change the respective positions of the two driers 97.

Figure 6:
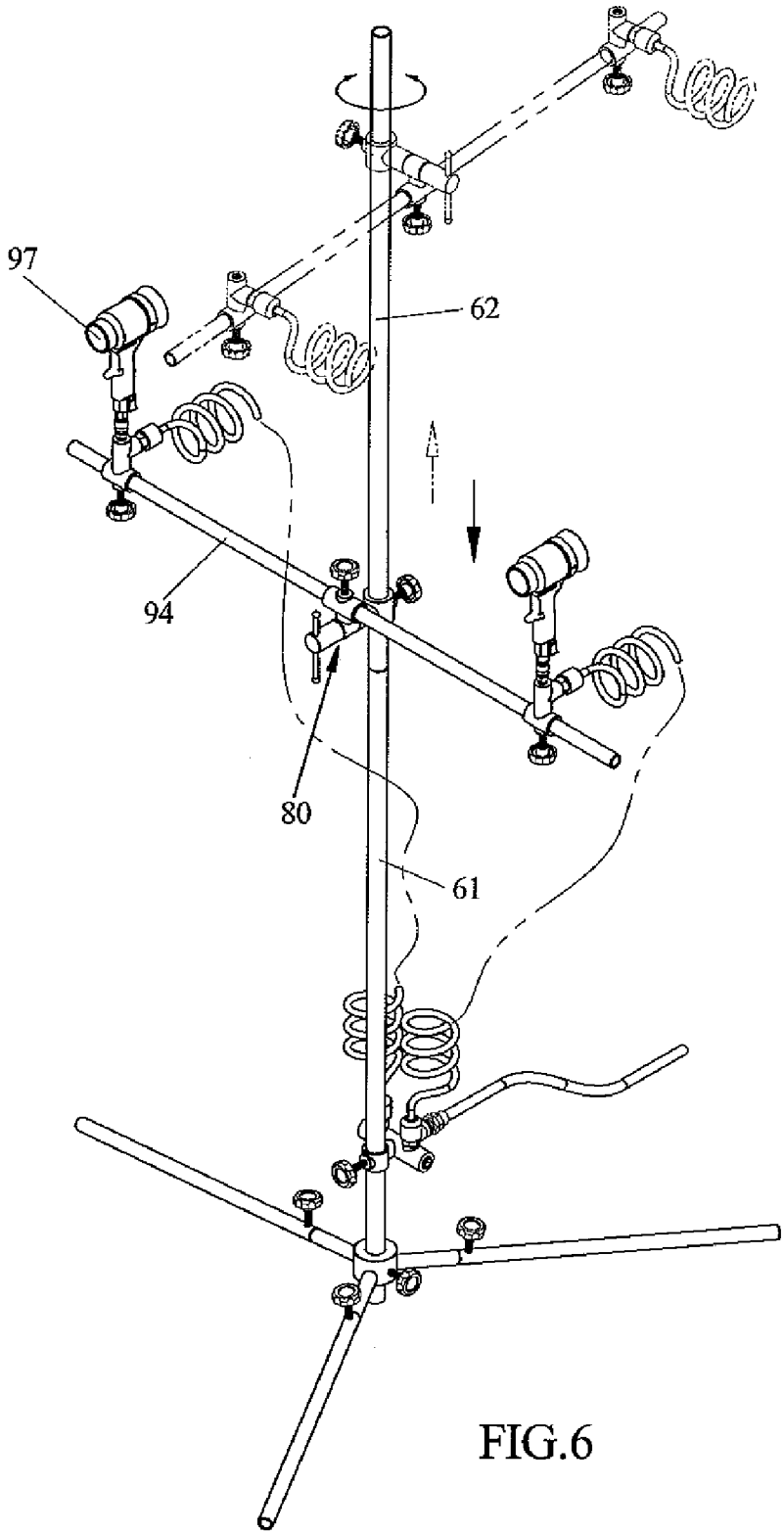
FIG. 6 shows that the horizontal tube and the driers are moved up and down along the Y-axis direction and rotated about the post assembly.
Figure 7:
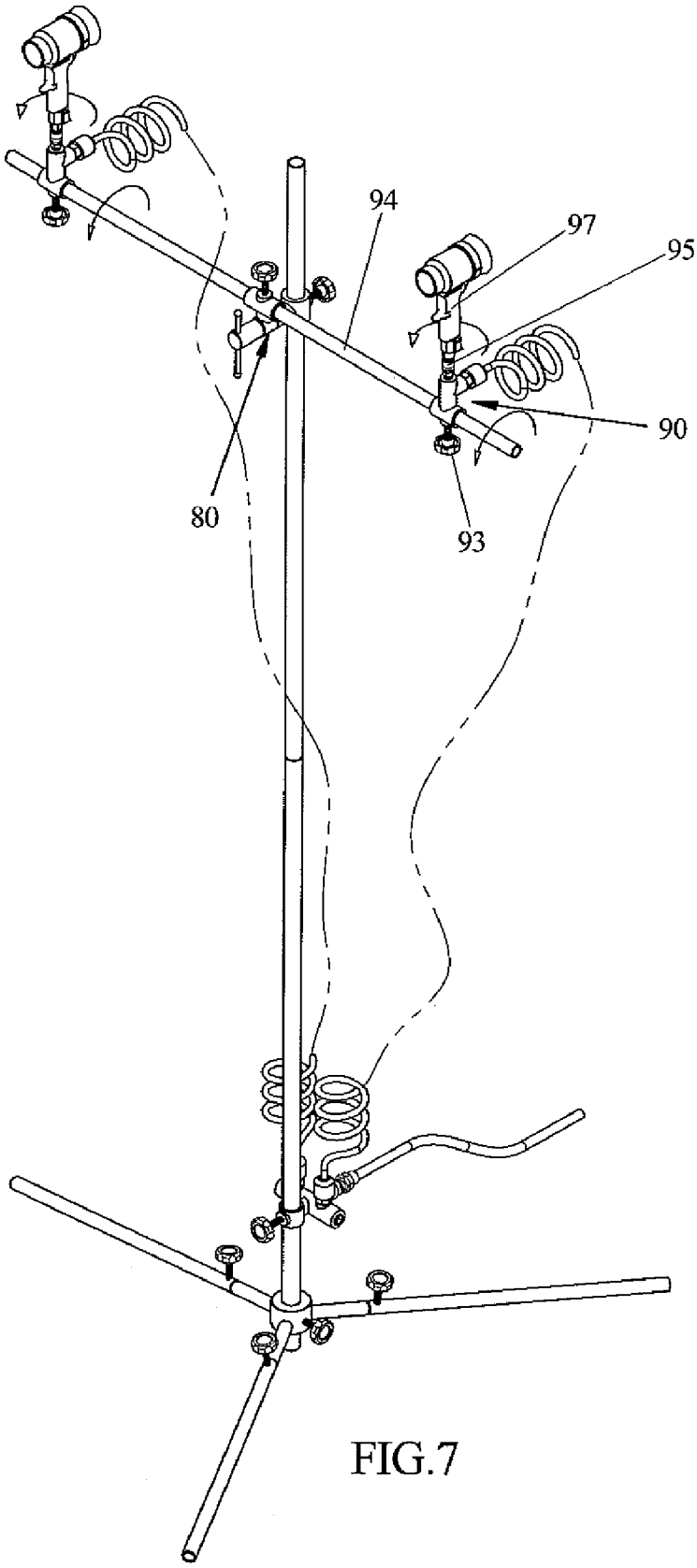
FIG. 7 shows that the horizontal tube is rotated about the X-axis direction.
Figure 9:
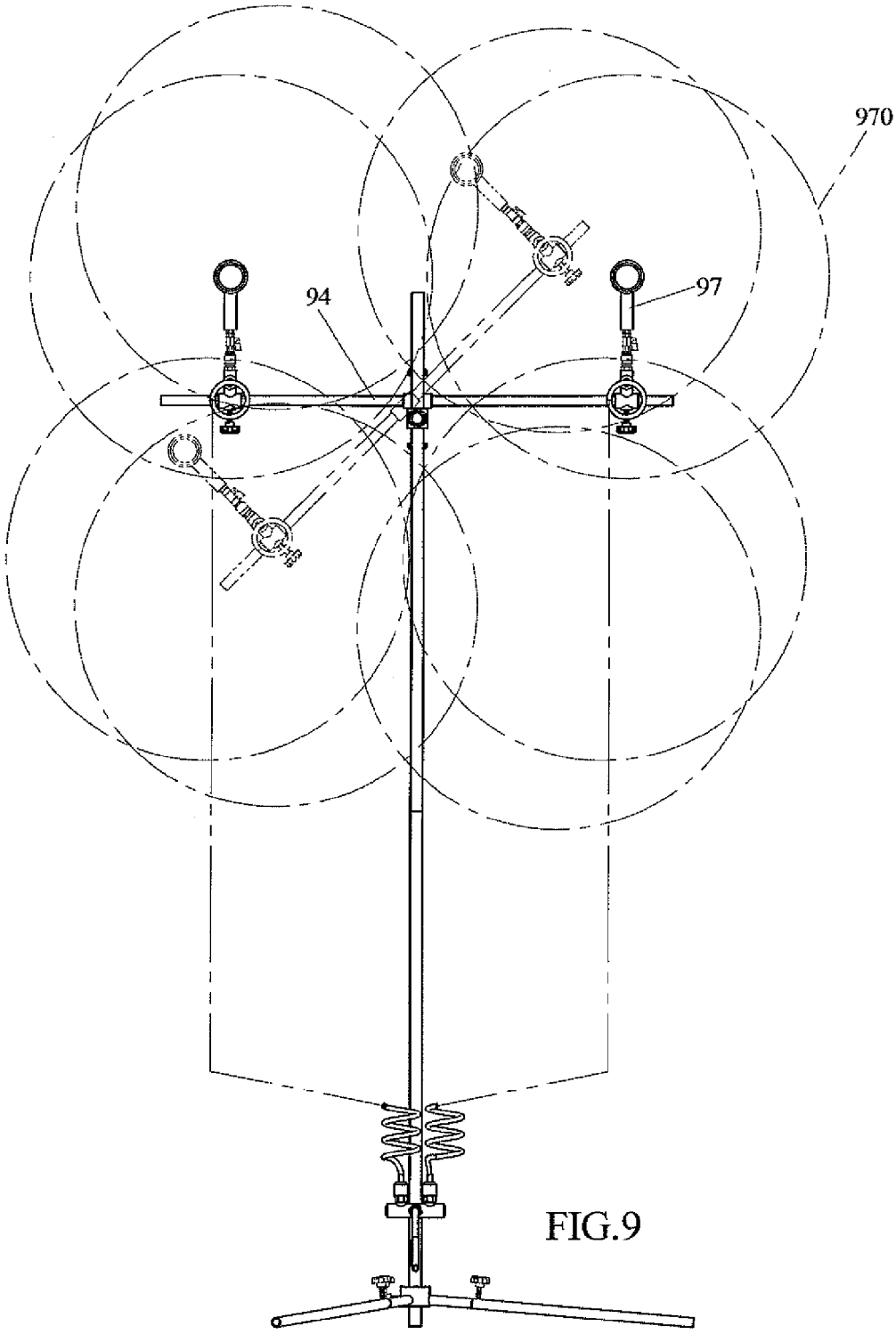
FIG. 9 shows the working areas of the driers on the rack.
Figure 10:
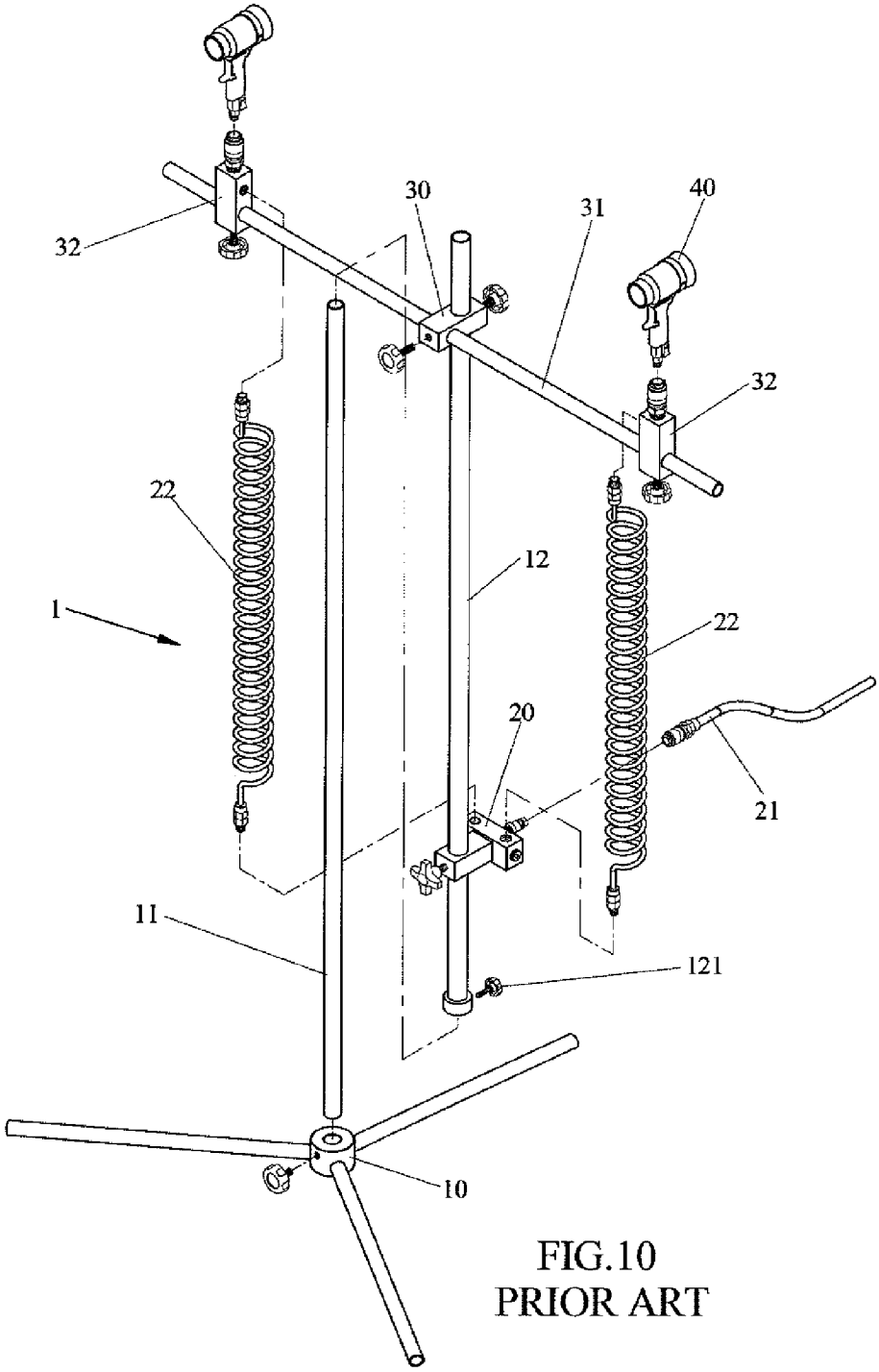
FIG.10 PRIOR ART
FIG. 10 is an exploded view to show a conventional rack for driers.
Figure 11:
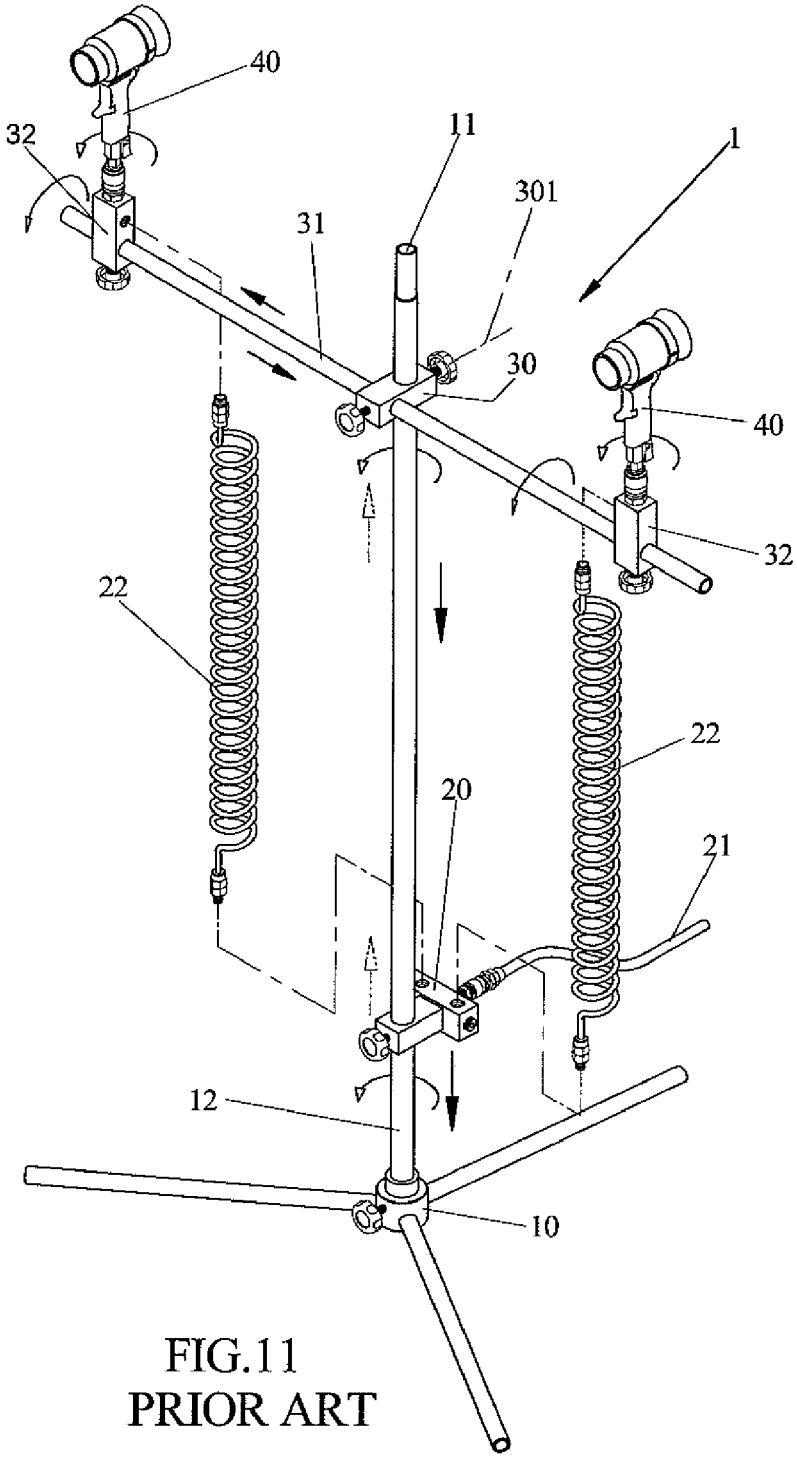
FIG.11 PRIOR ART
FIG. 11 shows the conventional rack for driers.
Figure 12:
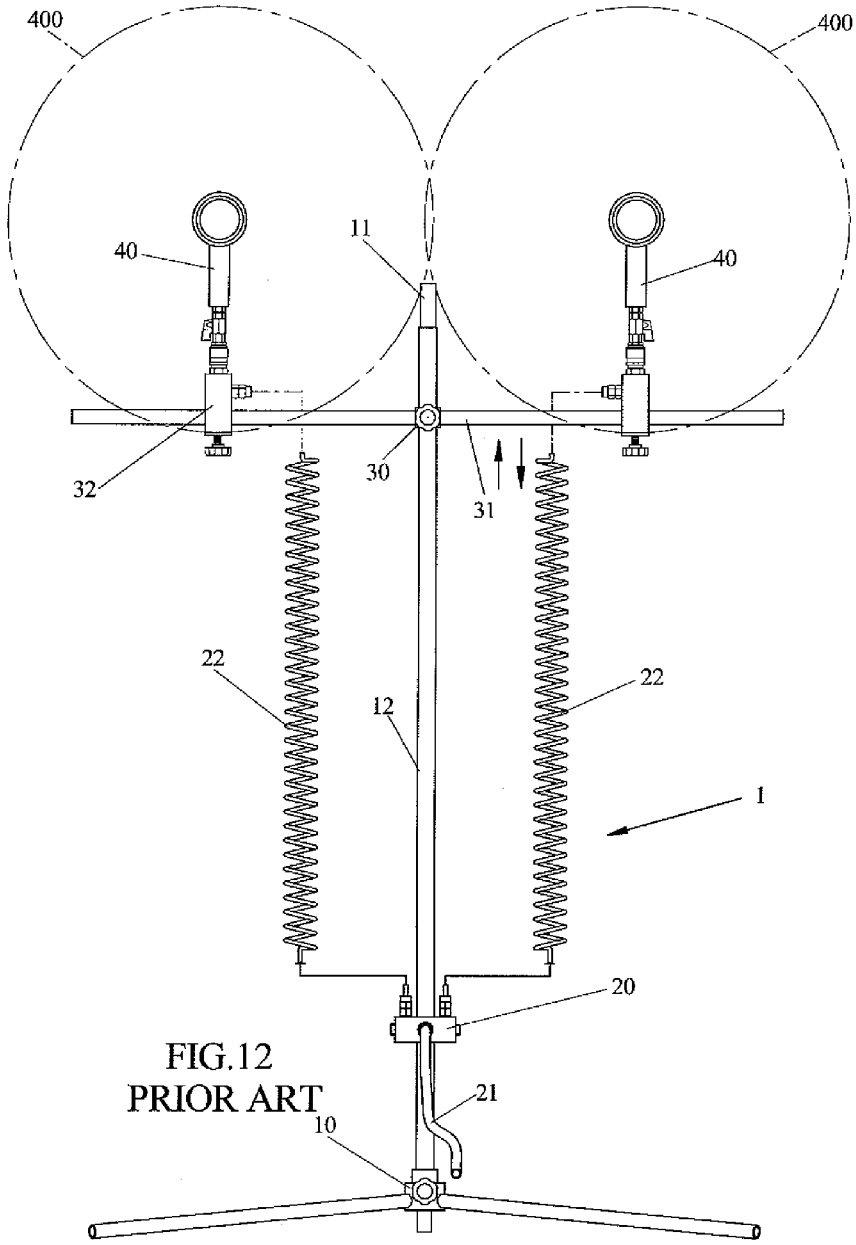
FIG.12 PRIOR ART
FIG. 12 shows the working area of the two driers of the conventional rack for driers.
Figure 13:
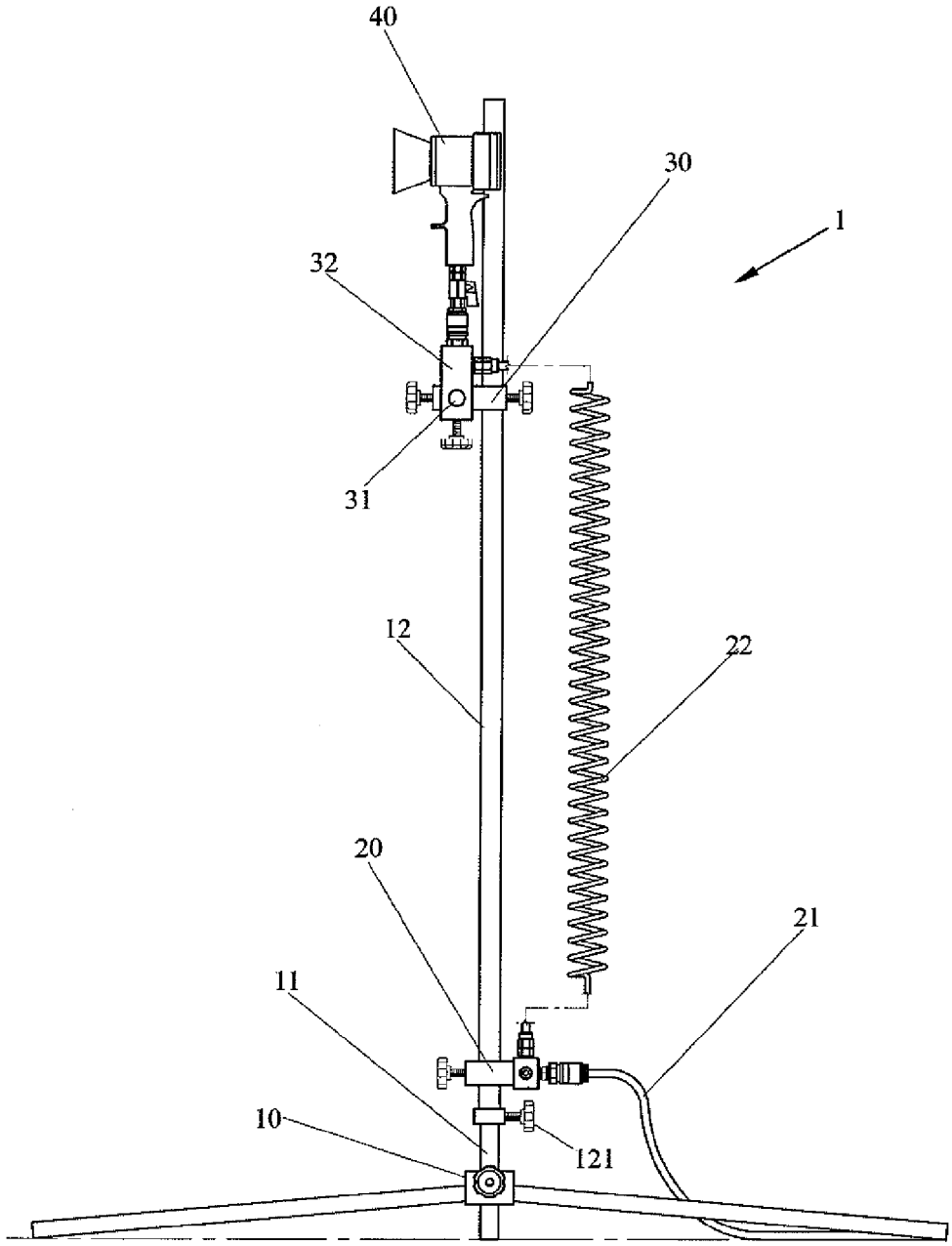
FIG.13 PRIOR ART
FIG. 13 shows a side view of the conventional rack for driers.
Figure 14:
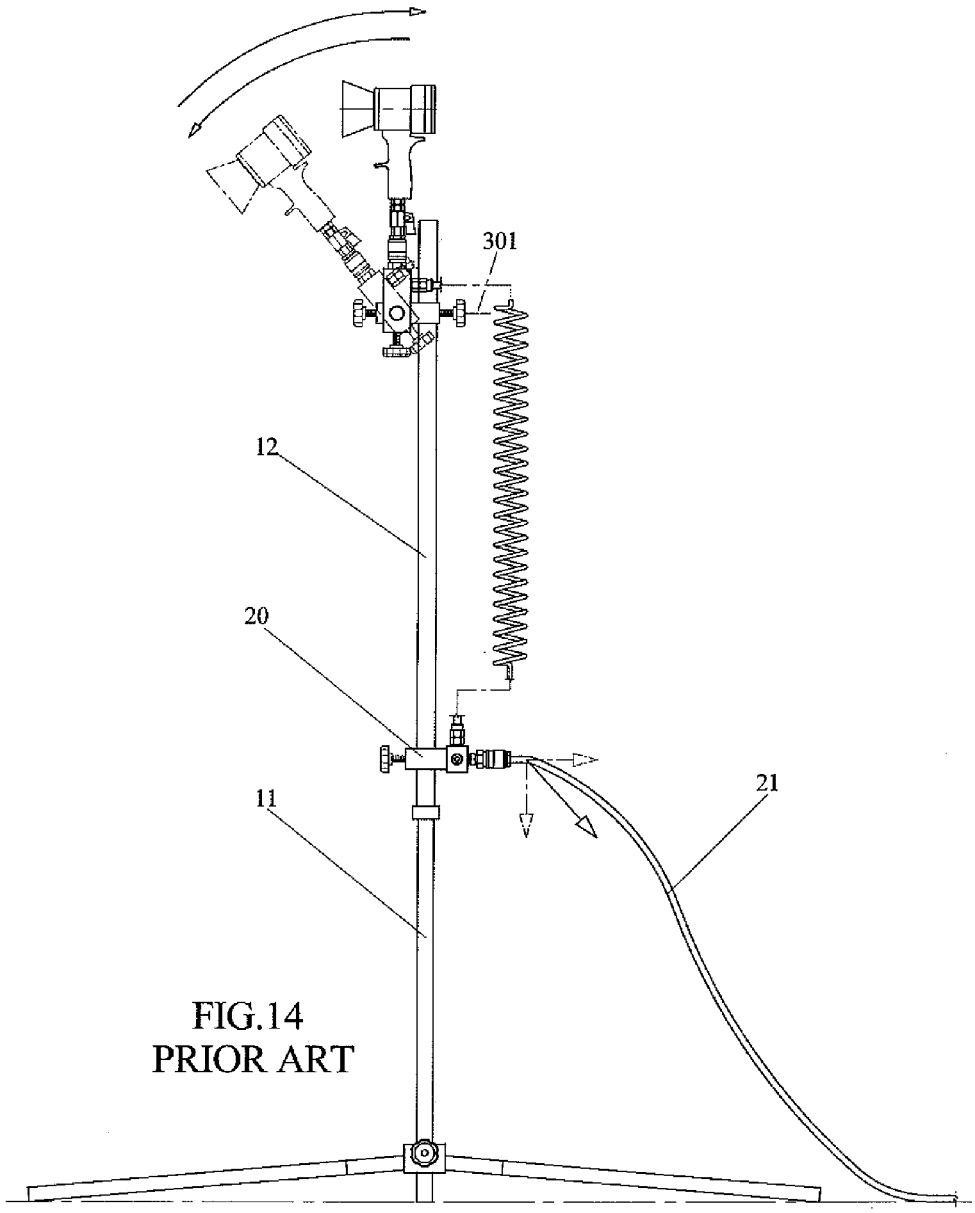
FIG.14 PRIOR ART
FIG. 14 shows the inlet unit and the inlet pipe of the conventional rack are moved upward.

FIG. 6 shows that the horizontal tube 94 and the driers 97 are moved up and down along the Y-axis direction and rotated about the post assembly. It is noted that the movement of the horizontal tube 94 does not move the inlet unit 70 so that the inlet unit 70 is still located at the lower position and is helpful to stabilize the rack. FIG. 7 shows that the horizontal tube 94 is rotated about the X-axis direction. FIG. 9 shows the possible working areas 970 of the driers 97 by using the rack of the present invention.

Figure 8:
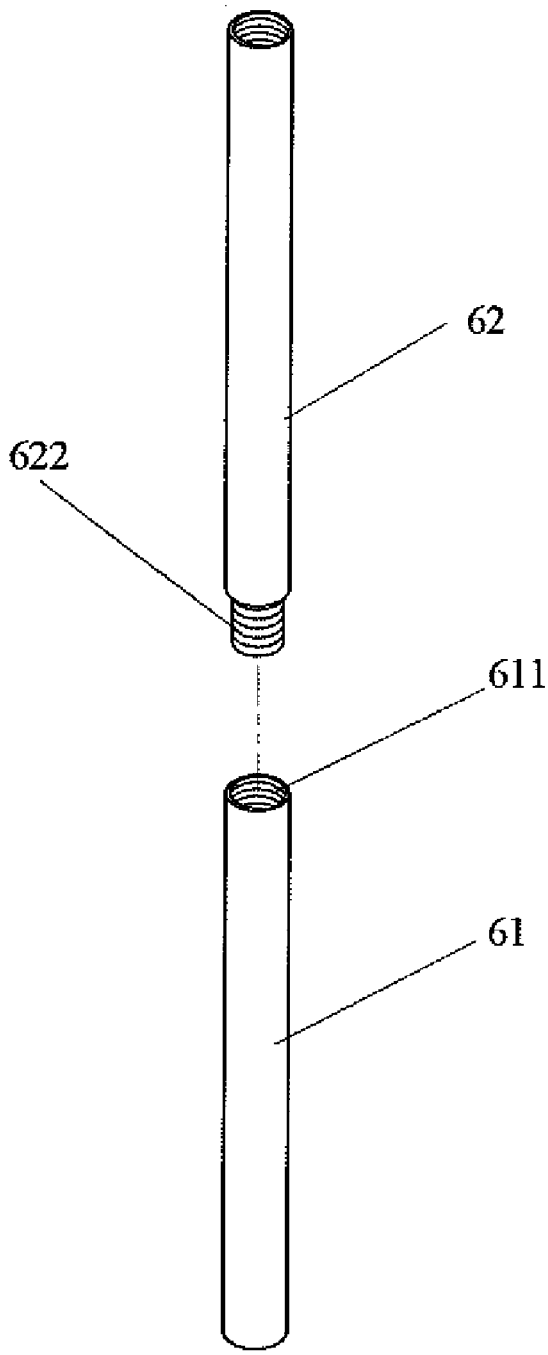
FIG. 8 shows another embodiment of the post assembly.

FIG. 8 shows another embodiment of the connection of the first and second tubes 61, 62, wherein a threaded end 622 extends from a lower end of the second tube 62 and is threadably connected with the threaded hole 611 in the top end of the first tube 61.

While the embodiment has been shown and described in accordance with the present invention, it should be clear to those skilled in the art that further embodiments may be made without departing from the scope of the present invention.

What is claimed is:

1. A rack for driers, comprising:

a support having a top hole;

a post assembly including a first tube which is connected to the top hole;

an inlet unit having an upright sleeve which is mounted to the first tube, a screw threadably extends through a threaded hole defined in the upright sleeve, two threaded holes defined in two ends of the inlet unit, two seal nuts connected with the threaded holes, a threaded hole defined in a front end of the inlet unit, a connection member connected with the threaded hole, an inlet hose connected with the connection member, two threaded holes defined in a top of the inlet unit, and two connection members connected with the threaded holes;

a rotatable unit having a vertical sleeve in a Y-axis direction so as to be mounted to the post assembly and a threaded hole defined through the vertical sleeve so that a screw threadably extends through the threaded hole of the rotatable unit and contacts against the post assembly;

a drier base including a horizontal sleeve which is mounted to a horizontal tube connected to the post assembly, a vertical sleeve connected to the horizontal sleeve, a threaded hole defined in a top of the vertical sleeve, a connection member threadably connected to the threaded hole in the top of the vertical sleeve, a drier connected with the connection member, the horizontal sleeve including a threaded hole in the Y-axis direction, a screw threadably extending through the threaded hole of the horizontal sleeve so as to fix the drier base to the horizontal tube, a connection portion extending radially from the vertical sleeve, a threaded hole defined in a distal end of the connection portion, and a connection member threadably connected with the threaded hole of the connection portion, the threaded hole of the connection portion in the distal end of the connection portion communicating with the threaded hole in the top of the vertical sleeve; and a spiral hose having one end connected with the connection member on the inlet unit and the other end of the spiral hose connected with the connection member on the vertical sleeve of the drier base.

2. The rack as claimed in claim 1, wherein a top end of the first tube is connected with a second tube.

3. The rack as claimed in claim 2, wherein a threaded hole is defined in the top end of the first tube and the second tube includes a threaded hole in a lower end thereof, a connection member is threadably connected between the two respective threaded holes and of the first and second tubes.

4. The rack as claimed in claim 2, wherein a threaded end extends from a lower end of the second tube and is threadably connected with a threaded hole in the top end of the first tube.

5. The rack as claimed in claim 1, wherein the vertical sleeve of the rotatable unit includes an extension tube extending radially therefrom, wherein the extension tube has a insertion section, a threaded hole defined in a distal end of the extension tube and an adjusting member threadably connected with the threaded hole of the extension tube.

6. The rack as claimed in claim 5, wherein the rotatable unit includes a horizontal sleeve which has a connection sleeve mounted to the insertion section, and a horizontal sleeve is connected to the connection sleeve and through which the horizontal tube extends, the horizontal sleeve includes a threaded hole, and a screw threadably connected to the threaded hole of the horizontal sleeve to fix the horizontal tube.

7. The rack as claimed in claim 6, wherein a threaded hole is defined in an underside of the connection sleeve and a screw is threadably connected to the threaded hole of the connection sleeve to contact against the insertion section.

8. The rack as claimed in claim 5, wherein a length of the connection sleeve is longer than a length of the insertion section so that the adjusting member contacts against an end surface of the connection sleeve.

* * * * *